US011454356B2

(12) United States Patent
Van Bommel et al.

(10) Patent No.: US 11,454,356 B2
(45) Date of Patent: Sep. 27, 2022

(54) SOLID STATE LAMP

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/601,356

(22) PCT Filed: Apr. 2, 2020

(86) PCT No.: PCT/EP2020/059425

§ 371 (c)(1),
(2) Date: Oct. 4, 2021

(87) PCT Pub. No.: WO2020/207902

PCT Pub. Date: Oct. 15, 2020

(65) Prior Publication Data

US 2022/0186890 A1 Jun. 16, 2022

(30) Foreign Application Priority Data

Apr. 11, 2019 (EP) ..... 19168679

(51) Int. Cl.
*F21K 9/232* (2016.01)
*F21K 9/235* (2016.01)
(Continued)

(52) U.S. Cl.
CPC ..... *F21K 9/232* (2016.08); *F21K 9/235* (2016.08); *F21V 3/0615* (2018.02); *F21Y 2115/10* (2016.08)

(58) Field of Classification Search
CPC ..... F21K 9/232; F21K 9/235; F21V 3/0615; F21Y 2115/10
See application file for complete search history.

(56) References Cited

U.S. PATENT DOCUMENTS

2012/0025235 A1 2/2012 Van De Ven et al.
2012/0320594 A1* 12/2012 Chien ..... F21V 21/14 362/249.03

(Continued)

FOREIGN PATENT DOCUMENTS

CN 207407082 U 5/2018
CN 207674139 U 7/2018

(Continued)

*Primary Examiner* — Evan P Dzierzynski
(74) *Attorney, Agent, or Firm* — Daniel J. Piotrowski

(57) ABSTRACT

The present invention relates to a lamp (1), comprising a lamp base (3), a semi-reflective envelope (2), at least one first solid state light source filament (4*a-d*) arranged inside the semi-reflective envelope (2), and a second solid state light source (5) arranged inside the semi-reflective envelope (2), wherein the reflectivity of the semi-reflective envelope (2) is in the range from 30% to 70% for light emitted by the at least one first solid state light source filament (4*a-d*) and the second solid state light source (5), wherein the at least one first solid state light source filament (4*a-d*) is arranged at a first distance lower than 7 millimeters from the semi-reflective envelope (2), and wherein the second solid state light source (5) is arranged at second distance higher than 15 millimeters from the semi-reflective envelope (2).

14 Claims, 6 Drawing Sheets

(51) Int. Cl.
*F21V 3/06* (2018.01)
*F21Y 115/10* (2016.01)

(56) References Cited

U.S. PATENT DOCUMENTS

| | | | | |
|---|---|---|---|---|
| 2014/0168977 | A1* | 6/2014 | Hu | F21V 29/83 362/249.02 |
| 2014/0268771 | A1* | 9/2014 | Heikman | F21V 29/506 362/249.02 |
| 2016/0116120 | A1 | 4/2016 | Kwisthout | |
| 2017/0167711 | A1* | 6/2017 | Kadijk | F21V 29/89 |
| 2018/0031183 | A1 | 2/2018 | Wegh et al. | |
| 2018/0112831 | A1* | 4/2018 | Huang | F21V 23/002 |
| 2018/0347802 | A1 | 12/2018 | Fu et al. | |

FOREIGN PATENT DOCUMENTS

| | | | |
|---|---|---|---|
| JP | 2015038853 | A | 2/2015 |
| WO | 2017114429 | A1 | 7/2017 |
| WO | 2018041826 | A1 | 3/2018 |

* cited by examiner

SOLID STATE LAMP

CROSS-REFERENCE TO PRIOR APPLICATIONS

This application is the U.S. National Phase application under 35 U.S.C. § 371 of International Application No. PCT/EP2020/059425, filed on Apr. 2, 2020, which claims the benefit of European Patent Application No. 19168679.9, filed on Apr. 11, 2019. These applications are hereby incorporated by reference herein.

FIELD OF THE INVENTION

The present invention relates to a solid state lamp.

BACKGROUND OF THE INVENTION

Incandescent lamps are rapidly being replaced by solid state light sources e.g. light emitting diodes (LED) based lighting solutions. It is nevertheless appreciated and desired by users to have retrofit lamps which have the look of an incandescent bulb. For this purpose, one can simply make use of the infrastructure for producing incandescent lamps based on glass and replace the conventional filament with LED filaments emitting white light. One of the concepts is based on LED filaments placed in such a bulb. The appearances of these lamps are highly appreciated as they look highly decorative.

In one example disclosed in CN 207407082, an LED filament lamp is presented with main and decorative illumination functions. The LED filament lamp provides a main lighting function with high lumen via a straight stripe type LED filament module. It also provides a decorative appearance via a variable type LED filament module which may extend helically around the main illumination filament. The proposed solution aims at providing an LED lamp combining the main and decorative illumination in one integrated solution to satisfy the needs of the user more cost effectively.

Generally, however, LED filament lamps when used at high intensities cause too much glare which may be at least temporarily dazzling for the user's eyes, or create discomfort and distraction. In the long run glare may cause more vision-related problems such as muscle fatigue in the eyes, eye irritation, difficulty focusing, or the like.

US 201/347802 discloses a gas-free light bulb device that has a lamp head, heatsink, a bulb, a glass core column, multiple filament assemblies, and a resilient extending element. The resilient extending element is mounted on the glass core and has a resilient rubber sleeve mounted around the glass core column and multiple resilient extending rubber bars connected respectively to the filament assemblies. When the gas-free light bulb device is operated with rising temperature, the resilient rubber sleeve is heated and loosened to slide upward and drive the filament assemblies to contact the bulb to effectively dissipate heat.

WO 2018/041826 discloses a light emitting device having a longitudinal axis (A) comprising at least one LED light source adapted for, in operation, emitting first light, at least one LED filament adapted for, in operation, emitting second light, at least one translucent core element, the translucent core element comprising a circumferential wall, an inner space enclosed by the circumferential wall, and an outer bulb enclosing the at least one translucent core element and the at least one LED filament, wherein the at least one LED light source being arranged in the inner space enclosed by the circumferential wall of the translucent core element, and the at least one LED filament being arranged outside of the at least one translucent core element, and wherein the at least one translucent core element is centrally arranged on the longitudinal axis (A).

SUMMARY OF THE INVENTION

It is an object of the present invention to overcome or at least alleviate the aforementioned glare problem with LED filament lamps.

According to a first aspect of the invention, this and other objects are achieved by a lamp, comprising:

a lamp base;

a semi-reflective envelope;

at least one first solid state light source filament arranged inside the semi-reflective envelope; and a second solid state light source arranged inside the semi-reflective envelope, wherein the reflectivity of the semi-reflective envelope is in the range from 30% to 70% for light emitted by the at least one first solid state light source filament and the second solid state light source, wherein the at least one first solid state light source filament is arranged at a first distance lower than 7 millimeters from the semi-reflective envelop, and wherein the second solid state light source is arranged at a second distance higher than 15 millimeters from the semi-reflective envelop.

The "reflectivity" may be defined as the fraction of the total light (emitted by the at least one first solid state light source filament and the second solid state light source) incident upon the envelope that is reflected. In other words, the reflectivity may be defined as the measure of the proportion of light striking a surface which is reflected off it. The reflectivity should apply (at least) to the visible wavelength range. The reflectivity is preferably constant along the visible wavelength.

Furthermore, the "first and second distances" may be construed as radial distances relative to a longitudinal axis of the lamp and/or as minimum distances measured perpendicular to the longitudinal axis of the lamp. Furthermore, the "first and second distances" are preferably construed as surface to surface distances.

Furthermore, the "solid state light source filament" as used here is to be understood as a light emitting source based on solid state light sources (e.g. LEDs) and having the appearance of being shaped as a filament. Typically, an LED filament comprises of a substrate shaped generally as a filament, and having an elongated body, and a plurality of LEDs mechanically coupled to the substrate.

The present invention is at least partly based on the realization that providing the above configuration enables projection of the at least one first solid state light source filaments onto the semi-reflective envelope, and thus the at least one filament is visible for a person. In that way, a desirable aesthetic look resembling the look of an incandescent light bulb may be created. Additionally, at high(er) lumen outputs, the second solid state light source—which is not visible to the person because it is arranged at a further distance from the semi-reflective envelope—may provide light to prevent glare.

Preferably, the reflectivity of the semi-reflective envelope is in the range from 35% to 65% for light emitted by the at least one first solid state light source filament and the second solid state light source. Most preferably, the reflectivity of the semi-reflective envelope is in the range from 40% to 60% for light emitted by the at least one first solid state light source filament and the second solid state light source. This provides an optimum in hiding power of the second solid state light source while still providing a high efficiency.

According to one embodiment, said at least one first solid state light source filament may be at least one LED (light emitting diode) filament, wherein said second solid state light source is a non-filament LED light source. That is, the second solid state light source is not an elongated light source. The second solid state light source may for example be an LED package, e.g. a chip on board (COB), Chip Scaled Package LED, or any other type of LED package. In other embodiments, OLEDs or PLEDs could be used. The LED filament may comprise a substrate mechanically supporting a plurality of LEDs. The substrate may be rigid or flexible. The LEDs may be arranged on one side of the substrate or on both sides of the substrate. The LEDs may be colored LEDs e.g. RGB LEDs. The LEDs may be white LEDs. White LEDs of different color temperatures may be used. Different (clusters) LEDs may be drive individually to enable color or color temperature control. The LEDs on the substrate may be covered by an encapsulant. The encapsulant may also cover part of the substrate. The encapsulant may cover the LEDs and one main surface of the substrate. The encapsulant may also cover to second main surface of the substrate. The encapsulant may comprise scattering material for mixing LED light, it may comprise e.g. $Al_2O_3$, $BaSO_4$, and/or $TiO_2$ particles. The encapsulant may comprise a luminescent material such as a phosphor. The LEDs may be UV and or blue LEDs. The luminescent material at least partly (or fully) convert LED light into converted LED light. The converted LED light is e.g. green/yellow and/or red light. The LED light and/or converted LED light forms the LED filament light. The LED filament may comprise at least ten LEDs, more preferably at least 15 LEDs, most preferably at least 20 LEDs. The LEDs are preferably arranged in a linear manner. The substrate of the LED filament has a length L, a width W and a height H. Preferably L/W is at least 10, more preferably at least 15, most preferably at least 20 such as e.g. 25 or 30. The length of the LED filament is preferably at least 4 cm, more preferably at least 5 cm, most preferably at least 6 cm such as 8 or 10 cm. The width W of the LED filament is preferably in the range of 1 to 5 mm. The thickness of the substrate is preferably in the range of 0.1 to 3 mm.

According to one embodiment, the lamp may have a longitudinal axis, wherein the second solid state light source may be arranged at the longitudinal axis. In this way, the light emitted by the second solid state light source may be more uniform. Furthermore, by arranging the second solid state light source on the longitudinal axis, the aforementioned second distance may be maximized. Thus max "hiding power" of the second solid state light source may be achieved.

According to one embodiment, the second solid state light source may be a color tunable light source. The color tunable light source may for example comprise at least one red LED, at least one green LED, and at least one blue LED. Here, the above configuration offers the additional advantage that suitable color mixing can be provided. That is, the semi-reflective envelope together with the color tunable light source may provide colored (background) light. Thus, a color controllable LED filament lamp may be provided. Alternatively or complementary, the second solid state light source may be a color temperature tunable light source.

In one embodiment, the first distance may be in the range of 0 to 2 mm. One advantage of this is that cooling of the at least one first solid state light source filament can be improved. More preferably, the first distance may be in the range of 0 to 1 mm. Most preferably, the first distance may be 0 mm. The closer the at least one first solid state light source filament is arranged to the semi-reflective envelope the better the cooling. Better thermal management means that the at least one first solid state light source filament can be driven at a higher current and thus provides a higher intensity thus higher luminous flux. Arranging the at least one first solid state light source filament closer to the light semi-reflective envelope provides better visibility of the contour of the at least one first solid state light source filament.

In another embodiment, the first distance may be in the range of 3 to 7 mm, which means $3<D1<7$ mm. In this way, homogenous lighting may be improved. In other words, the contour of he at least one first solid state light source filament is visible, but more in a more 'gentle/smooth' way.

According to at least one embodiment, the shape of the at least one first solid state light source filament may be at least partly matching the (adjacent) shape of the semi-reflective envelope. An advantage of this is that the projection of the light emitted from the LED filaments at least one first solid state light source filament onto the semi-reflective envelope may be improved. The at least one first solid state light source filament may for example at least partly follow a curvature of the semi-reflective envelope as seen in a longitudinal plane of the lamp. The top portion of the at least one first solid state light source filament may for instance be bent to match the semi-reflective envelope having a "straight-tubular" shape (e.g. ST64).

The at least one first solid state light source filament may have the shape of a helix with at least three turns, preferably at least four turns, most preferably at least five turns.

The at least first solid state light source filament may cover at least 50% (more preferably at least 60%, most preferably at least 70%) of the length of the semi-reflective envelope as seen in a longitudinal plane of the lamp. Long filaments may improve the decorative appearance of the lamp.

In one embodiment, the at least one first solid state light source filament may be configured to emit light of a first color temperature, wherein the second solid state light source may be configured to emit light of a second color temperature different than the first color temperature. The obtained effect of this is better projection of the at least one first solid state light source filament. The at least one first solid state light source filament may for example appear white of a high(er) color temperature, while the other areas of the semi-reflective envelope appear white of a low(er) color temperature (or the other way around).

According to one embodiment, the lamp may be configured such that at a total luminous flux below a total luminous flux threshold only the at least one first solid state light source filament may emit light, and such that at a total luminous flux on or above the total luminous flux threshold both the at least one first solid state light source filament and the second solid state light source may emit light. An advantage of this is that the at least one first solid state light source filament can be better projected onto the semi-reflective envelope at lower light levels. Also, it prevents glare at higher lumen outputs. To achieve this, the lamp may for example comprise a controller configured to control the at least one first solid state light source filament and the second solid state light source as described above based on an input signal indicating a desired total luminous flux. The input signal could be the voltage waveform supplied by an external dimmer or a wireless signal from an external control device such as a smartphone or tablet.

The lamp may be further configured such that at a total luminous flux above the total luminous flux threshold, the second solid state light source may provide more light (i.e. have a higher luminous flux) than the at least one first solid state light source filament. This has the advantageous effect of (further) reducing glare at even higher lumen outputs.

In various embodiments, the total luminous flux threshold may be in the range of 300 to 500 lm, more preferably 330 to 450, and most preferably 350 to 420 lm.

According to yet another embodiment, the lamp may further comprise means configured to move the at least one solid state light source filament from the first distance to another distance with respect to the semi-reflective envelope, wherein the another distance may be higher than 15 millimeters. In this embodiment, the second solid state light source could be omitted. Hence there is envisaged a lamp, comprising: a lamp base; a semi-reflective envelope; at least one solid state light source (e.g. LED) filament arranged inside the semi-reflective envelope; and moving means configured to move said at least one solid state light source filament from a first distance gradually or in steps to a second distance with respect to the semi-reflective envelope, wherein the reflectivity of the semi-reflective envelope is in the range from 30% to 70% for light emitted by the at least one first solid state light source filament. In this way, the filament(s) may disappear, thereby preventing glare. The first distance is preferably lower than 10 millimeters (more preferably lower than 7 mm, most preferably lower than 5 mm) from the semi-reflective envelope, whereby the at least one at least one solid state light source filament is visible. The second distance is preferably higher than 15 millimeters (more preferably higher than 18 mm, most preferably higher than 20 mm) from the semi-reflective envelope, whereby the at least one at least one solid state light source filament is invisible, i.e. disappeared. In some preferable embodiments the first distance may be lower than 10 millimeters. The reflectivity of the semi-reflective envelope is more preferably in the range from 35% to 65% (most preferably 40% to 60%) for light emitted from the at least one solid state light source filament. The displacement of the at least one solid state light source filament (as performed by the moving means) is preferably in a direction perpendicular to the surface of the semi-reflective envelope. The moving means may be controlled manually (e.g. by using a ring, knob, slider on the outside of the lamp which is connected the moving means inside the lamp) or automatically (e.g. by a motor and using a remote control).

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, some features including portions of the semi-reflective envelope or the LED filament maybe exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
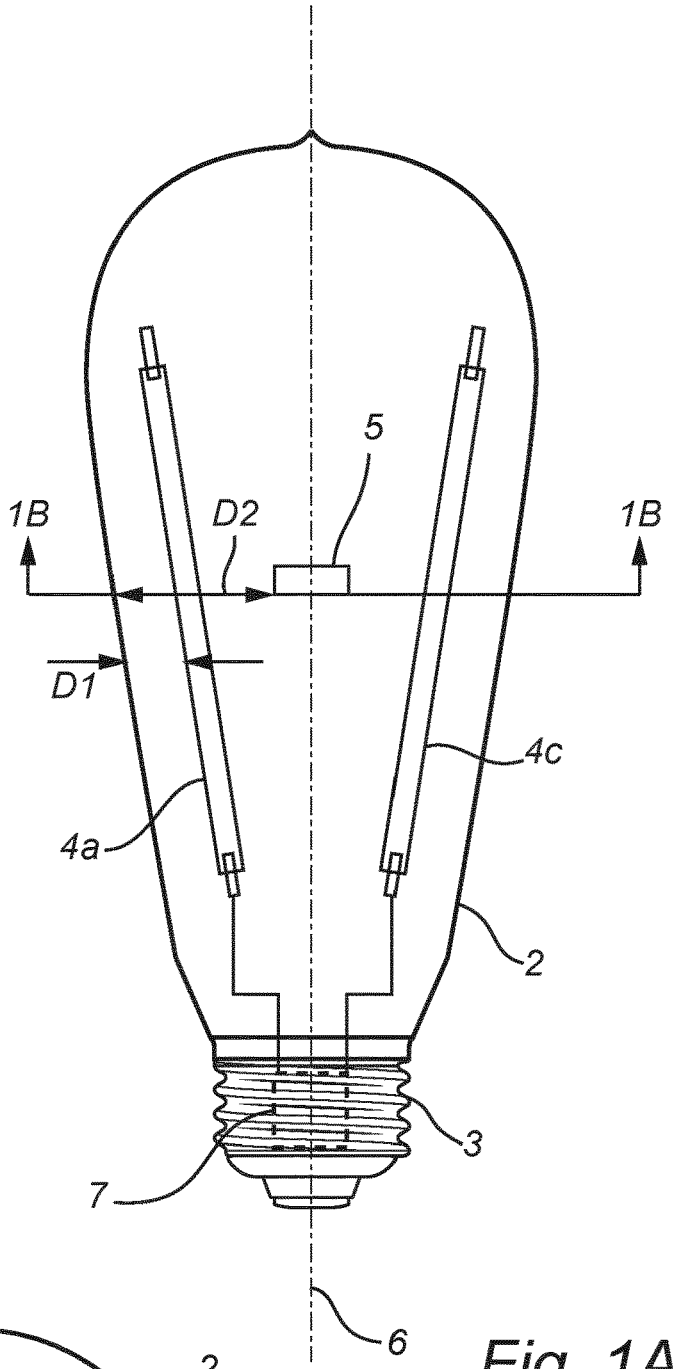
FIGS. 1*a-b* respectively show schematic side and cross sectional views of a solid state lamp in accordance with at least one embodiment of the present invention.
Figure 1B:
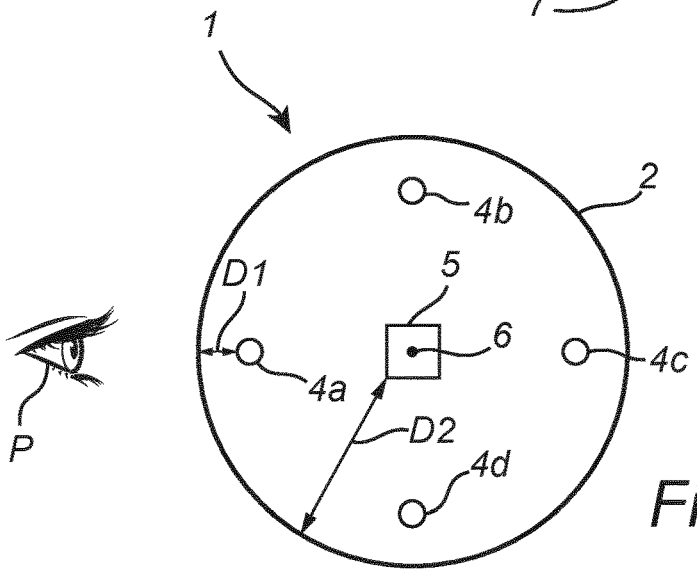

FIGS. 1*a-b* illustrate a lamp 1 according to an embodiment of the invention. The lamp 1 is intended to have a look of an incandescent light bulb which is found to be highly appreciated by the viewers. The lamp 1 may be referred to as a retrofit lamp or an LED bulb or a filament LED bulb.

The lamp 1 comprises a lamp base 3. The lamp base 3 may also be referred to as a cap or cap base. The lamp base 3 is adapted to mechanically and electrically connect the lamp 1 to a lamp socket (not shown). The lamp base 3 may for example be a screw base.

The lamp 1 further comprises a semi-reflective envelope 2. The semi-reflective envelope 2 is connected to the lamp base 3, either directly or via an intermediate member. The semi-reflective envelope 2 may for example have a "straight-tubular" bulbshape as in FIG. 1*a* (e.g. ST64), though other shapes are possible as well. The height of the lamp 1 (envelope+base) may for example be about 14 cm, and the maximum width may be 6.4 cm.

The lamp 1 further comprises at least one first solid state light source filament, here four LED filaments 4*a-d*. Each LED filament 4*a-d* may comprise a substrate having an elongated body, and a plurality of LEDs mechanically coupled to the substrate. The LED filaments 4*a-d* may for example be adapted to emit white light. The white light is preferably within 12 SDCM from the BBL (Standard Deviation Colour Matching from the Black Body Locus), more preferably <10, most preferably <7. The white light has preferably a color temperature in the range from 2000 K to 8000 K, more preferably 2100 K to 5000 K, most preferably 2200 K to 4000 K. The CRI (Color Rendering Index) is preferably at least 70, more preferably at least 80, most preferably at least 85 such as for example 88 or 92. The LED filaments 4*a-d* are here straight, generally upright oriented, slightly tilted relative to the longitudinal axis 6 of the lamp 1, and parallel to the (frusto-conical portion) of the semi-reflective envelope 2. As can be seen in FIG. 1*b*, the LED filaments 4*a-d* are evenly distributed along the circumference of the semi-reflective envelope 2. Because the LED filaments 4*a-d* are not positioned on the central longitudinal axis 6 and the semi-reflective envelope 2 is a mixing chamber, light—in operation—is impinging on the inner surface of the semi-reflective envelope 2 from several angles. Please not that in FIG. 1*a* only LED filaments 4*a* and 4*c* are shown for brevity.

Within the context of the present invention, a LED filament is providing LED filament light and comprises a plurality of light emitting diodes (LEDs) arranged in a linear array. Preferably, the LED filament has a length L and a width W, wherein L>5W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

The lamp 1 further comprises a second light source 5, here a non-filament LED light source. The LED light source 5 may for example be an LED package. The LED light source 5 may for example be adapted to emit white light. The LED light source 5 is here arranged at (on) the central longitudinal axis 6. Furthermore, the LED light source 5 may be positioned in level with the LED filaments 4*a-d*, as seen along the longitudinal axis 6.

The lamp 1 may further comprise a controller 7 generally adapted to control the light output of the LED filaments 4*a-d* and the LED light source 5.

The reflectivity of the semi-reflective envelope 2 is in the range from 30% to 70% for light emitted by the at least one first solid state light source filament 4*a-b* and the second solid state light source 5. The semi-reflective envelope 2 may be, or act as, a diffuser configured to diffuse light. The semi-reflective envelope 2 can for example be made of clear glass provided with a coating to achieve the desired reflectivity. The coating may for example be a light scattering coating on the inside of the envelope 2. For example, a polymer matrix (e.g. of silicone, PMMA, PC, PET) comprising scattering particles (silicone, $TiO_2$, $BaSO_4$, and/or $Al_2O_3$ particles) or (air) bubbles may be used. Alternatively or complementary, the semi-reflective envelope 2 itself may be scattering. At an exemplary reflectivity of 50%, half of the light from the LED filaments 4*a-d* and the LED light source 5 is reflected by the semi-reflective envelope 2. Of the rest, most light is transmitted through the semi-reflective envelope 2, whereas some is absorbed by the semi-reflective envelope 2.

The LED filaments 4*a-d* are arranged at a first distance D1 from the semi-reflective envelope 2. The first distance D1 may be defined as a radial distance relative to the longitudinal axis 6 and/or as the minimum distance between the filament 4 and the envelope 2 measured perpendicular to the longitudinal axis 6. The first distance D1 is preferably <7 mm. That distance together with the above-discussed reflectivity enables projection of the LED filaments 4*a-b* onto the semi-reflective envelope 2 and thus the LED filament 4*a-b* are visible for a person. Specifically, in FIG. 1*b*, LED filament 4*a* is visible to person P. If the first distance D1 is in the range of 0 to 2 mm, cooling of the at least one first solid state light source filament can be improved. If the first distance D1 is in the range of 3 to 7 mm (3<D1<7 mm), homogenous lighting may be improved. Preferably the complete (or substantially the complete) at least one LED filament 4*a-d* is closer to the semi-reflective envelope 2 than 7 mm. In other words, D1, i.e. the minimum distance between the at least one LED filament 4*a-d* and the envelope 2 measured perpendicular to the longitudinal axis 6, is less than 7 mm at any point along the length of the at least one LED filament 4*a-d*. In FIG. 1*a*, the first distance D1 to the most adjacent point on the semi-reflective envelope 2 is constant throughout the length of the LED filaments 4*a-d*.

The LED light source 5 is arranged at a second distance D2 from the semi-reflective envelope 2. The second distance D2 may be defined as a radial distance relative to the longitudinal axis 6 and/or as the minimum distance between the filament 4 and the envelope 2 measured perpendicular to the longitudinal axis 6. The second distance D2 is preferably >15 mm. That distance together with the above-discussed reflectivity makes the LED light source 5 invisible for the person, whereby glare may be prevented.

Figure 2:
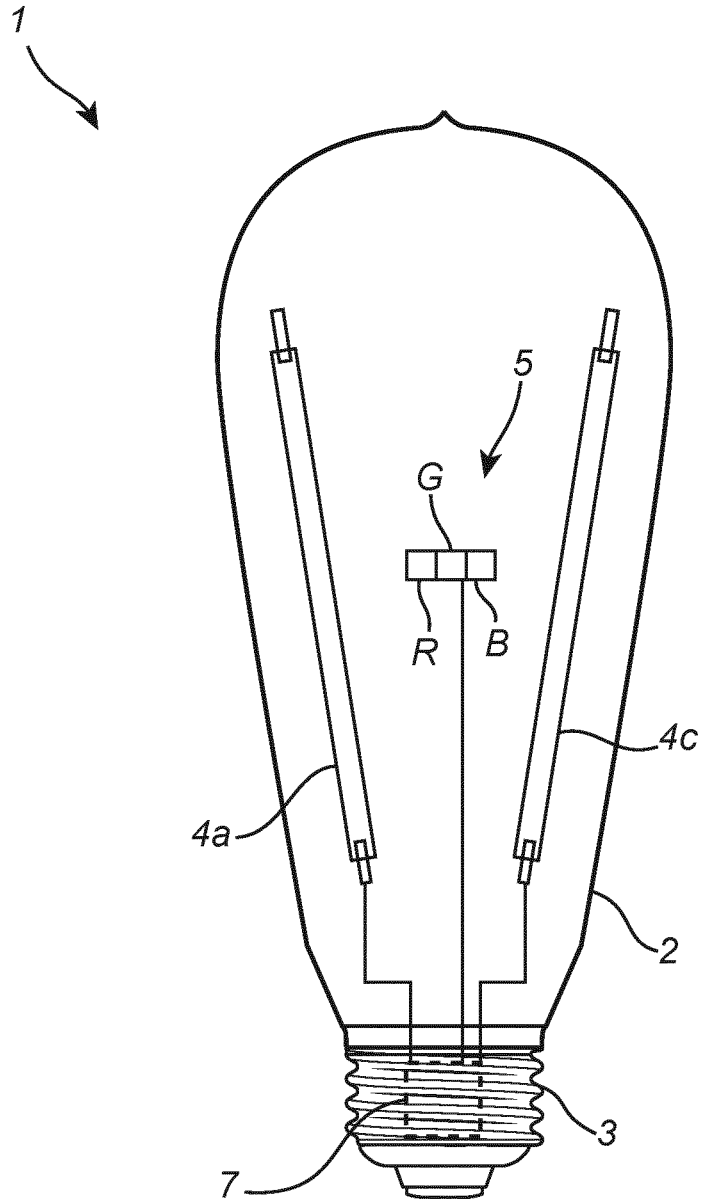
FIG. 2 shows a schematic side view of a solid state lamp in accordance with at least one other embodiment of the present invention.

FIG. 2 illustrates a lamp 1 according to another embodiment of the invention. This lamp 1 is similar to the lamp in FIGS. 1*a-b*, except that the second solid state light source 5 is a color tunable light source. The color tunable light source 5 may for example comprise at least one red LED "R", at least one green LED "G", and at least one blue LED "B". The red, green, and blue LEDs could be individually controlled by the controller 7, whereby a color controllable LED filament lamp 1 may be provided.

Figure 3A:
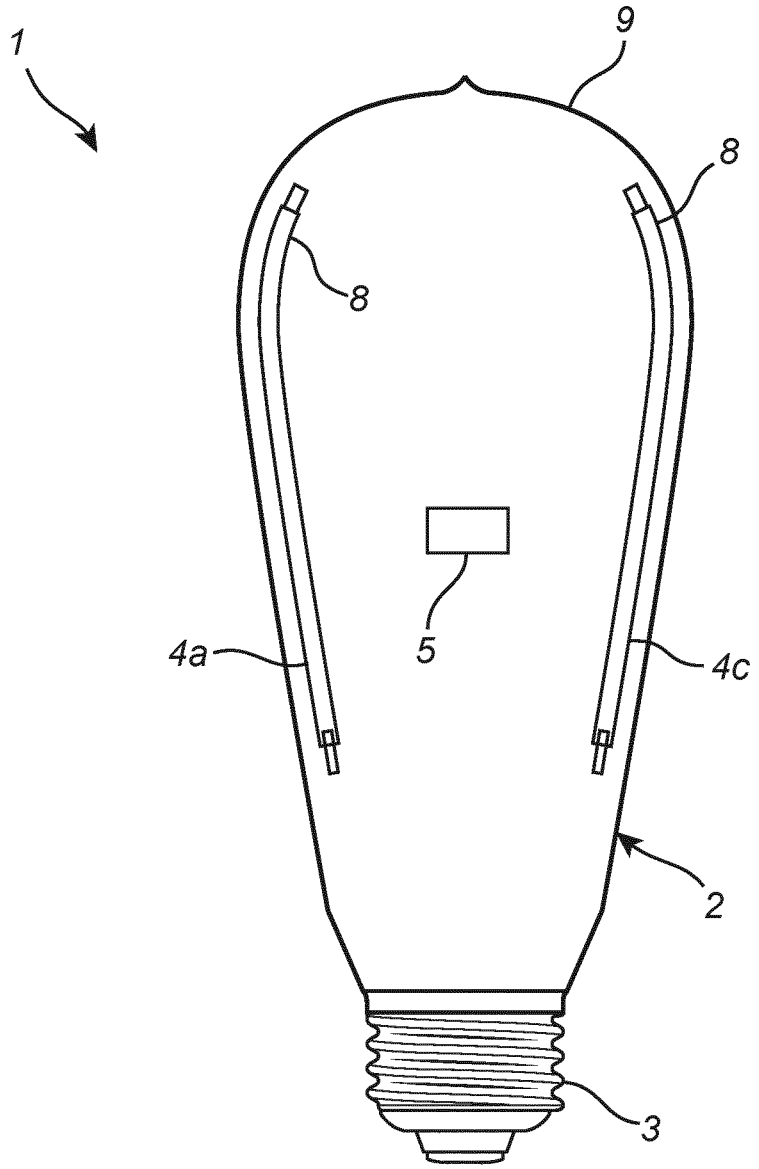
FIGS. 3*a-d* show schematic side views of a solid state lamps in accordance with further embodiments of the present invention.
Figure 3B:
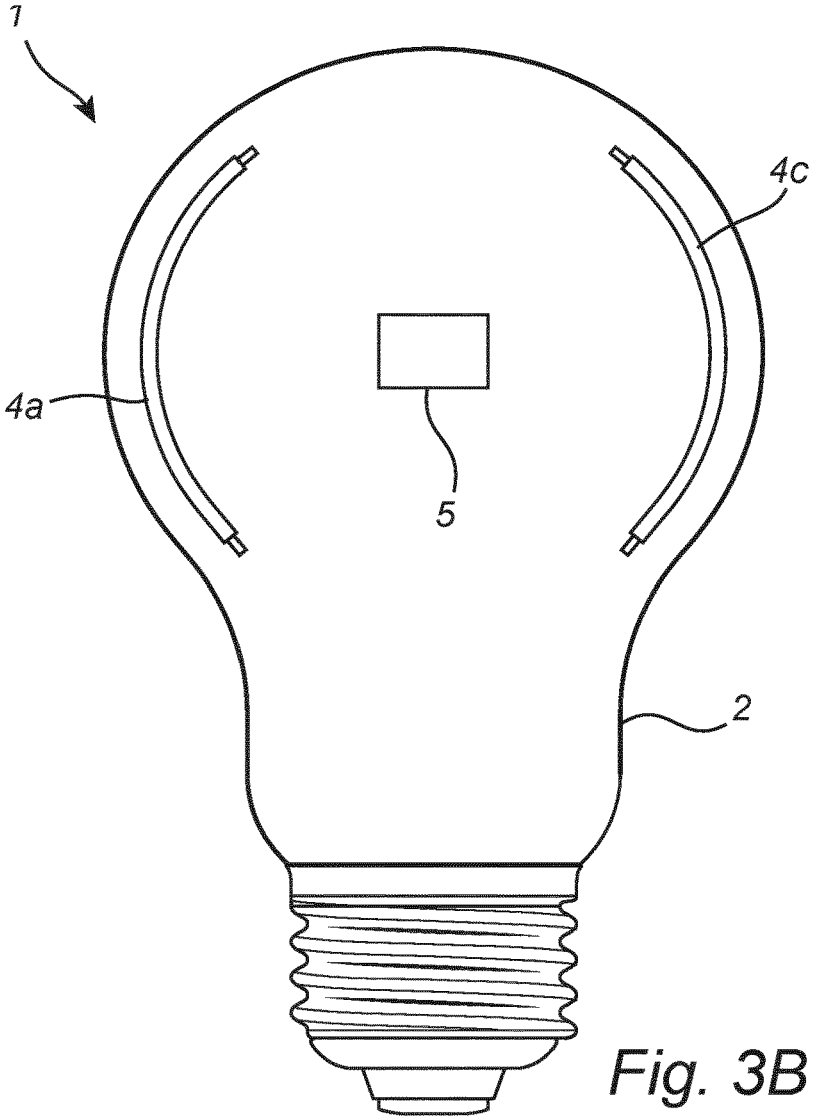

FIGS. 3*a-b* illustrate lamps 1 according to further embodiments of the invention. These lamps may be similar to the lamp in FIGS. 1*a-b*, except that the LED filaments 4*a-d* at least partly follow a curvature of the semi-reflective envelope 2, as seen in a longitudinal plane of the lamp 1 (i.e. the plane of the paper or screen where you are viewing these figures). In FIG. 3*a*, the top portion 8 of each LED filament 4*a-d* is bent to match the dome-shaped top portion 9 of the semi-reflective envelope 2. In FIG. 3*b*, the complete LED filaments 4*a-d* are bent (curved) to match the semi-reflective envelope 2 having an A-shape. It is appreciated that the distance D1 may be constant throughout the length of the LED filaments 4*a-d* also in these embodiments.

Figure 3C:
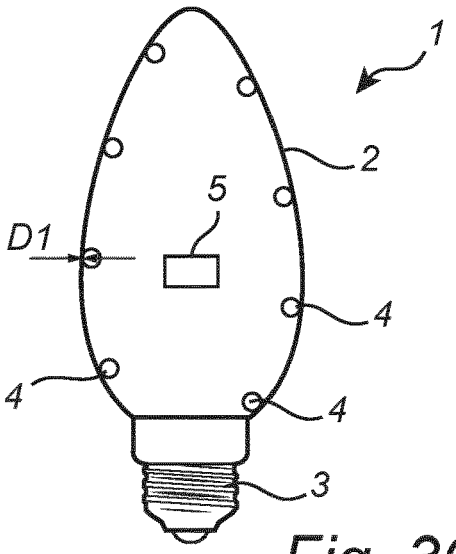
Figure 3D:
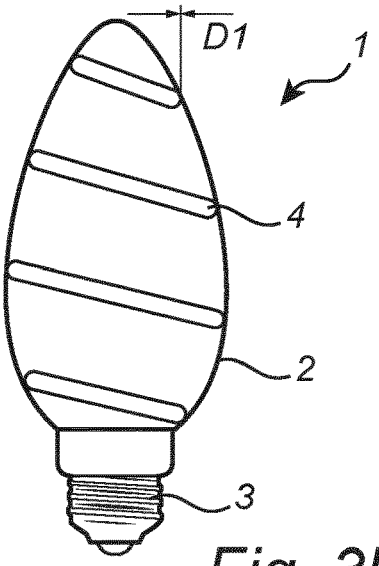

In FIGS. 3*c-d*, the lamp 1 may be similar to the lamp in FIGS. 1*a-b*, except that it has at least one LED filament 4 shaped like a helix and that the semi-reflective envelope 2 is here candle-shaped. FIG. 3*c* is a cross-sectional view, and FIG. 3*d* is side view of the lamp 1 when turned on. By varying the radius of the helix-shaped at least one LED filament 4, the first distance D1 (here 0 mm) may be constant throughout the length of the at least one LED filament 4. The illustrated LED filament 4 has three and a half turns.

Figure 4A:
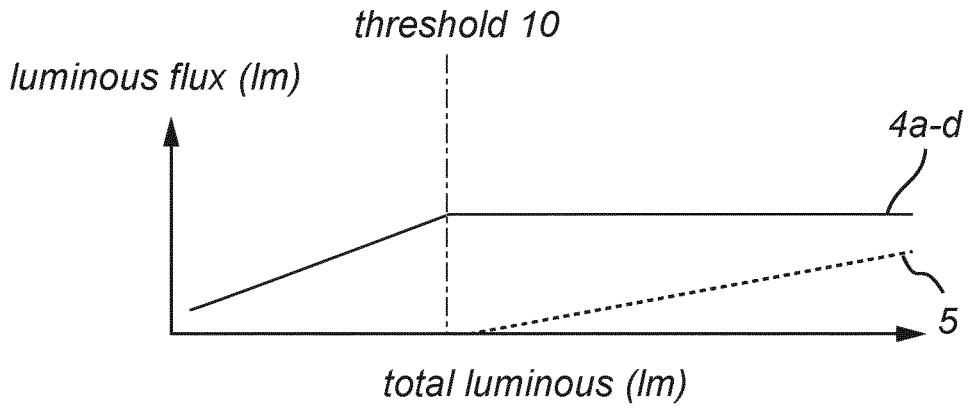
FIGS. 4*a-c* show exemplary operations of the lamp according to various embodiments of the present invention.
Figure 4B:
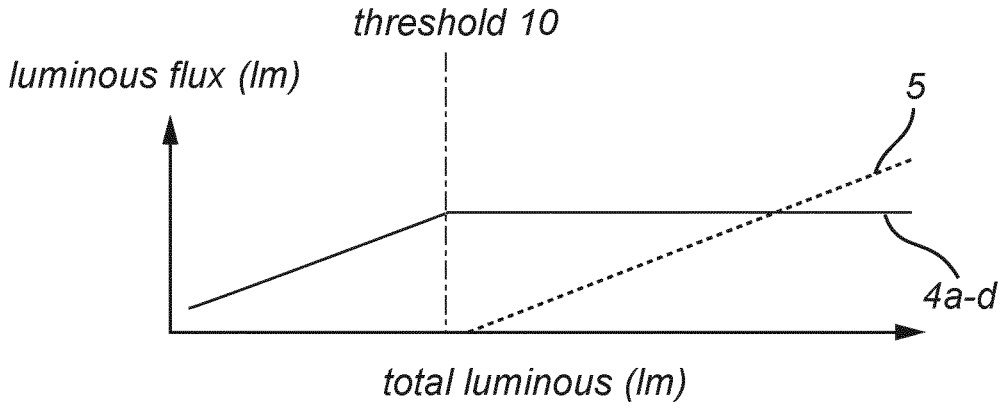
Figure 4C:
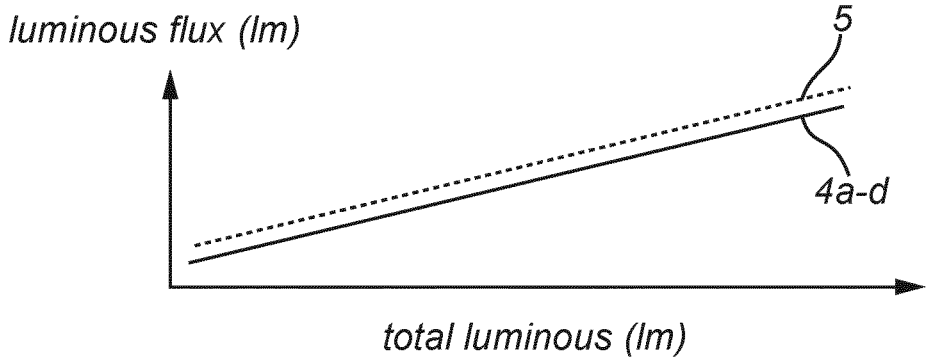

FIGS. 4*a-c* show exemplary operations of the lamp 1 according to various embodiments of the present invention, for example the lamp 1 shown in FIGS. 1*a-b*.

In FIG. 4*a*, the controller 7 is configured to control the LED filaments 4*a-d* and the LED light source 5 such that at a total luminous flux below a total luminous flux threshold 10 only the LED filaments 4*a-d* emit light (whereas the LED light source 5 is off), and such that at a total luminous flux on or above the total luminous flux threshold 10 both the LED filaments 4*a-d* and the LED light source 5 emit light. The total luminous flux threshold 10 may be in the range of 300 to 500 lm (lumen). Furthermore, the maximum output of the LED filaments 4*a-d* may be equal to the value of the total luminous flux threshold 10, as in FIG. 4*a*.

In FIG. 4*b*, the controller 7 is configured to control the LED filaments 4*a-d* and the LED light source 5 such that at a total luminous flux above the total luminous flux threshold 10, e.g. at or above 400 lm in case the threshold 10 is 300 lm, the LED light source 5 provides more light than the LED filament 4*a-d*.

In FIG. 4*c*, the LED filaments 4*a-d* and the LED light source 5 provide different color temperatures, and the controller 7 may be configured to control the LED filaments 4*a-d* and the LED light source 5 such that both emits light at any total luminous flux.

Figure 5:
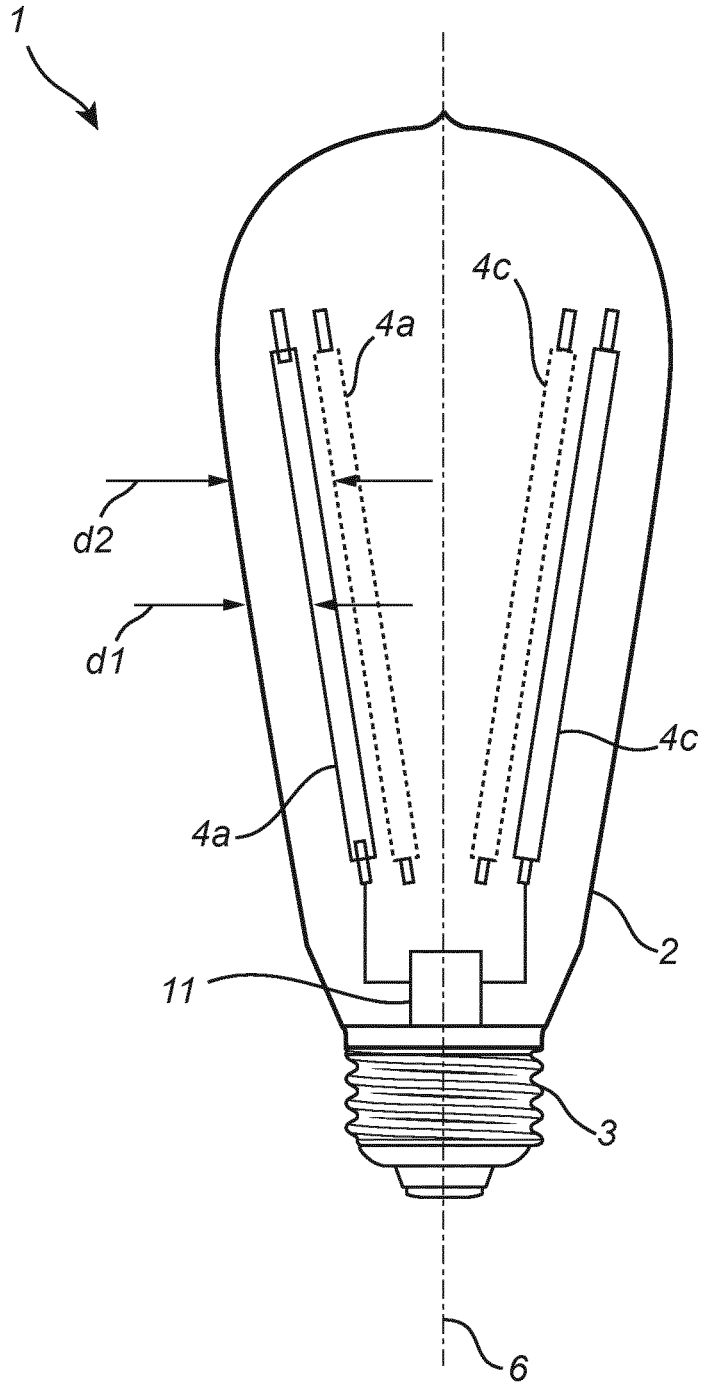
FIG. 5 is a schematic side view of a lamp according to yet another embodiment of the present invention.

FIG. 5 illustrate a lamp 1 according to yet another embodiment. This lamp 1 is similar to the lamp in FIGS. 1*a-b*, except that is does not include the LED light source 5. Instead, it includes moving means 11 configured to move the at least one solid state light source filament 4 from a first distance d1 gradually or in steps to a second distance d2 with respect to the semi-reflective envelope.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lamp, comprising:

a lamp base;

a semi-reflective envelope;

at least one first solid state light source filament arranged inside the semi-reflective envelope; and a second solid state light source arranged inside the semi-reflective envelope, wherein the reflectivity of the semi-reflective envelope is in the range from 30% to 70% for light emitted by the at least one first solid state light source filament and the second solid state light source, wherein said at least one first solid state light source filament is arranged at a first distance lower than 7 millimeters from the semi-reflective envelop, and wherein said second solid state light source is arranged at a second distance higher than 15 millimeters from the semi-reflective envelop.

2. The lamp according to claim 1, wherein said at least one first solid state light source filament is at least one LED filament, and wherein said second solid state light source is a non-filament LED light source.

3. The lamp according to claim 1, wherein said lamp has a longitudinal axis, and wherein said second solid state light source is arranged at said longitudinal axis.

4. The lamp according to claim 1, wherein said second solid state light source is a color temperature and/or color tunable light source.

5. The lamp according to claim 1, wherein said first distance is in the range of 0 to 2 mm.

6. The lamp according to claim 1, wherein said first distance is in the range of 3 to 7 mm (that is $3<D1<7$ mm).

7. The lamp according to claim 1, wherein the shape of said at least one first solid state light source filament is at least partly matching the shape of said semi-reflective envelope.

8. The lamp according to claim 7, wherein the at least one first solid state light source filament at least partly follows a curvature of the semi-reflective envelope as seen in a longitudinal plane of the lamp.

9. The lamp according to claim 1, wherein the at least one first solid state light source filament has the shape of a helix with at least three turns.

10. The lamp according to claim 1, wherein the at least first solid state light source filament covers at least 50% of the length of the semi-reflective envelope as seen in a longitudinal plane of the lamp.

11. The lamp according to claim 1, wherein the at least one first solid state light source filament is configured to emit light of a first color temperature, and wherein the second solid state light source is configured to emit light of a second color temperature different than the first color temperature.

12. The lamp according to claim 1, further comprising a controller configured to control the at least one first solid state light source filament and the second solid state light source -such that at a total luminous flux below a total luminous flux threshold only the at least one first solid state light source filament emits light, and such that at a total luminous flux on or above the total luminous flux threshold both the at least one first solid state light source filament and the second solid state light source emit light.

13. The lamp according to claim 12, further configured such that at a total luminous flux above said total luminous flux threshold, said second solid state light source provides more light than said at least one first solid state light source filament.

14. The lamp according to claim 12, wherein said total luminous flux threshold is in the range of 300 to 500 lm.

* * * * *